US006321827B1

(12) United States Patent
Divjak et al.

(10) Patent No.: US 6,321,827 B1
(45) Date of Patent: Nov. 27, 2001

(54) SUPPORTING ROLL FRAMEWORK FOR CONTINUOUS METAL, ESPECIALLY STEEL CASTING PLANTS

(75) Inventors: Franz-Josef Divjak, Rheinberg; Hans-Werner Gohres, Duisburg; Klaus Peter Klasen, Düsseldorf; Rainer Lenk; Manfred Kocian, both of Duisburg, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/508,027

(22) PCT Filed: Aug. 14, 1998

(86) PCT No.: PCT/DE98/02465

§ 371 Date: Mar. 6, 2000

§ 102(e) Date: Mar. 6, 2000

(87) PCT Pub. No.: WO99/11405

PCT Pub. Date: Mar. 11, 1999

(30) Foreign Application Priority Data

Sep. 4, 1997 (DE) ..... 197 39 694

(51) Int. Cl.[7] ..... B22D 11/12; B22D 11/124
(52) U.S. Cl. ..... 164/441; 164/448; 164/443
(58) Field of Search ..... 164/441, 443, 164/448, 428, 442

(56) References Cited

U.S. PATENT DOCUMENTS 3,603,377 * 9/1971 Khimich et al. ..... 164/282
4,034,796 * 7/1977 Loibl et al. ..... 164/282
4,146,083 * 3/1979 Scheurecker et al. ..... 164/448
4,485,837 * 12/1984 Wiesinger et al. ..... 164/448
4,559,990 * 12/1985 Greilinger et al. ..... 164/428
6,059,013 * 5/2000 Krume ..... 164/448

FOREIGN PATENT DOCUMENTS 1 282 240 * 11/1968 (DE) .
196 06 308 C * 4/1997 (DE) .

* cited by examiner

*Primary Examiner*—Blaine Copenheaver
*Assistant Examiner*—Len Tran
(74) *Attorney, Agent, or Firm*—Cohen, Pontani, Lieberman & Pavane

(57) ABSTRACT

A supporting roll framework for continuous metal, in particular steel, casting installations, which is divided into straight or curved segments with roll carriers, a plurality of rolls being assembled on one roll carrier. The frame element, as a carrying element, has at least two pipes, which lie parallel to and at a distance from one another, transversely with respect to the running direction of the strand, and between which a web plate is welded in. A holding plate, which is directed toward the strand, is attached to the respectively outer lateral surface of the outer pipes, between which holding plates the carrier which carries the rolls is welded in. The pipes, in the case of internally cooled rolls, function as the cooling medium supply and discharge and, for this purpose, are provided with a connection stub on the outer lateral surface.

4 Claims, 3 Drawing Sheets

SUPPORTING ROLL FRAMEWORK FOR CONTINUOUS METAL, ESPECIALLY STEEL CASTING PLANTS

BACKGROUND OF THE INVENTION

1. FIELD OF THE INVENTION

The invention relates to a supporting roll framework for continuous metal, in particular steel, casting installations

2. DISCUSSION OF THE PRIOR ART

A supporting roll framework of the generic type is known from DE German reference 196 06 308 B1. This supporting roll framework is divided into straight or curved segments with roll carriers, a plurality of rolls being assembled on one roll carrier. In each case two roll carriers, designed as a flexurally rigid frame element in the form of a welded sheet construction, for parallel end sides are attached to holding elements which run on both sides next to the cross section of the casting strand. The rolls are mounted on both sides in bearings, the housings of which are in turn connected to the roll carrier. Both frame elements have a protruding extension at each end, between which in each case one side element, which is designed in the form of welded sheet construction, is pressed in and releasably connected to the two frame elements by means of expansion-shank bolts. The flexurally and torsionally rigid supporting roll segment formed in this way has smooth and planar inner surfaces. Both frame elements are provided with carriers which extend in the running direction of the strand, are of T-shaped design and to which the corresponding bearing housing is releasably attached. The cooling medium supply and discharge is integrated in the frame element, and the bearing housing, which is likewise cooled, is connected to the cooling medium supply or discharge by means of a passage formed in the T-shaped carrier.

A drawback of this known supporting roll framework is the difficulty of access in the event of a defective roller or a defective bearing. Another drawback is the way in which the cooling medium is guided in the frame element, since the cooling medium flowing back from the roll in question is guided through the frame part with a number of diversions.

SUMMARY OF THE INVENTION

The object of the invention is to provide a supporting roll framework for continuous metal, in particular steel, casting installations which, while achieving the same flexural and torsional rigidity, is more easily accessible in order to allow simplified maintenance and can optionally be used for a dry and a wet process. A further object is to simplify the guidance of cooling medium in the frame element.

According to the invention, this is achieved by means of a frame element which, as a carrying element, has at least two pipes which lie parallel to and at a distance from one another, transversely with respect to the running direction of the strand. A reinforcing web plate is welded in between the pipes. In each case one holding plate directed toward the strand is attached to the outer lateral surface of the outer pipes, between which holding plates the carrier which carries the rolls is welded in. In the case of internally cooled rolls, the pipes function as a cooling medium supply and discharge, which for this purpose are provided with a connection stub on the outside lateral surface.

The frame elements formed in this way are connected to the side elements by means of the protruding extension which is known per se and has, matched to the pipe design, a section which is of peg-like design and can be pressed into the pipe and, adjoining this section, a flat section which rests on the narrow sides, facing toward the frame elements, of the side elements. The frame element advantageously has three pipes which are arranged symmetrically and at a distance from one another as the carrying element, the middle pipe being provided with a connection stub for the spray water. In this way, it is also possible, in a simple manner, to optionally select a wet process using the supporting roll framework.

To improve guidance of the cooling medium in the pipes, which are designed as the carrying element, these pipes have a coaxially arranged displacement pipe which has a smaller external diameter than the internal diameter of the carrying element.

The advantage of the proposed construction is that to simplify maintenance the accessibility has been facilitated and the cooling-medium guidance in the frame element has been simplified.

BRIEF DESCRIPTION OF THE DRAWINGS

The supporting roll framework designed according to the invention is explained in more detail in the drawing with reference to an exemplary embodiment. In the drawing.

DETAILED DESCRIPTION OF THE PREFERRED EMBODIMENTS

Figure 1:
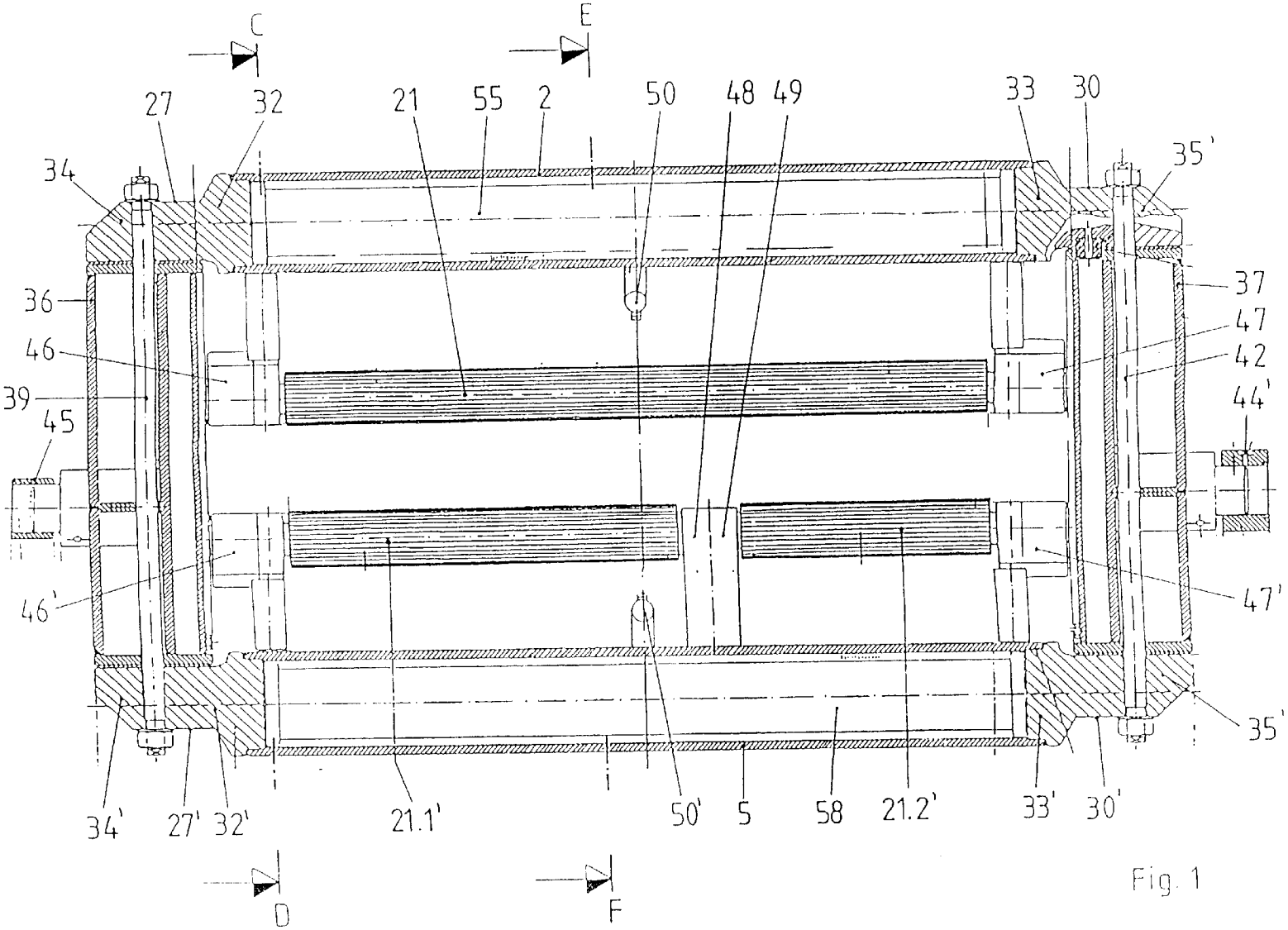
FIG. 1 shows a section in direction A–B in FIG. 2.
Figure 2:
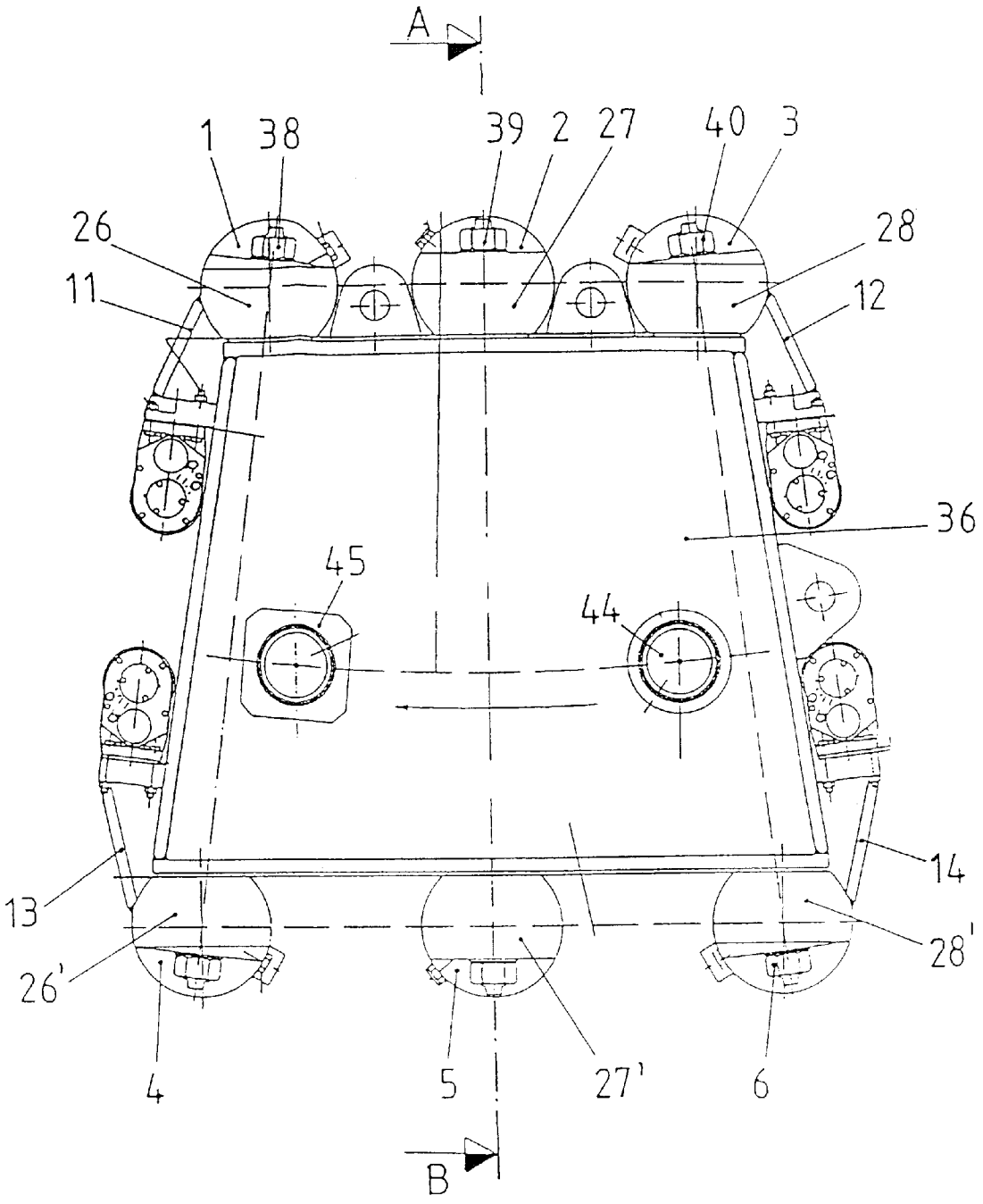
FIG. 2 shows a side view of FIG. 1.
Figure 4:
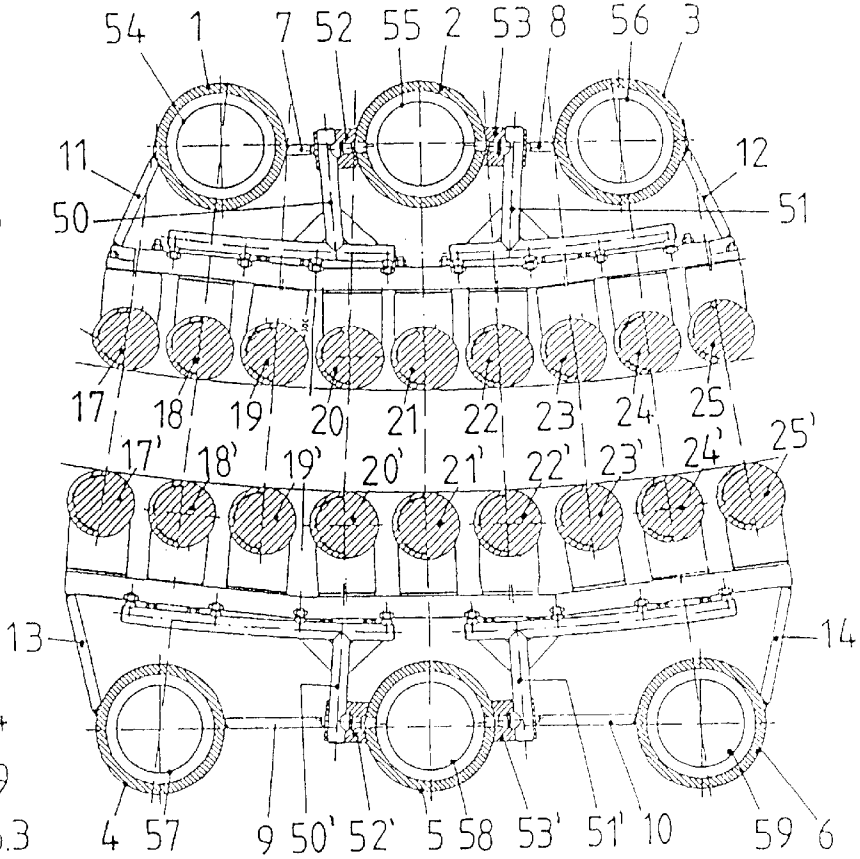
FIG. 4 shows a section E-F in FIG. 1.
Figure 3:
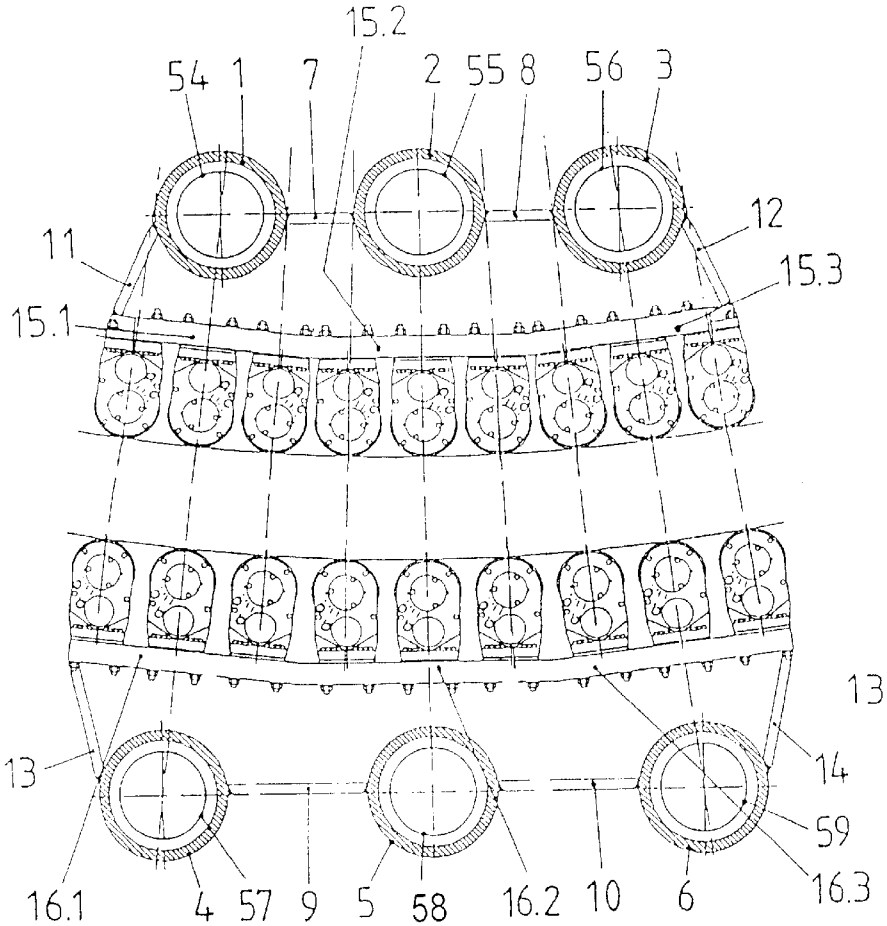
FIG. 3 shows a section C-D in FIG. 1.

FIG. 1 shows a section and FIG. 2 a side view of the segment, designed according to the invention, of a supporting roll framework. In this exemplary embodiment, a curved segment is illustrated for a bow-type continuous casting installation. As a carrying element, this segment has pipes 1–6 which are arranged symmetrically and in each case form the top and bottom frame elements. The pipes 1–6 lie transversely with respect to the running direction of the strand. Between them, as shown by FIGS. 3 and 4, there are web plates 7–10. In the case of the outer pipes 1, 3 and 4, 6, holding plates 11, 12, 13, 14 facing toward the strand are attached to the outer lateral surface of the pipes. A carrier, which has three sections 15.1, 15.2, 15.3, 16.1, 16.2, 16.3, is attached between these holding plates 11, 12 and 13, 14, respectively. Three pairs of rolls are attached to each carrier section by means of bolts. In total, in this segment there are 9 roll pairs 17, 17'–25, 25'. The corresponding frame element is thus formed by three pipes 1–3 or 4–6, intermediate web plates 7, 8 or 9, 10, external holding plates 11, 12 or 13, 14, and carriers 15.1–15.3 or 16.1–16.3. At both ends, the pipes 1–3 or 4–6 are provided with protruding extensions 26, 26'–28, 28' or 29, 29'–31, 31'. Each extension has a peg-like section 32, 32', 33, 33' which can be fitted into the corresponding pipe 2, 5 and, adjoining this section, a flat-running section 34, 34', 35, 35'. The flat running section 34, 34', 35, 35' is designed so that a side element 36 or 37, which is designed as a welded sheet construction, is attached releasably between the top and bottom frame elements by means of expansion bolts 38–43. The inner surfaces of the side elements 36, 37 are smooth, so that it is impossible for any dirt to accumulate at this point. To make it possible to hang the segment in the carrying frame of the supporting roll framework (not shown here), in each case two outwardly extending pegs 44, 44', 45, 45' are arranged on the side elements 36, 37. One peg is designed as a moveable bearing, the other as a fixed bearing. The top part of FIG. 1 shows the dual mounting 46, 47 of a single-piece continuous supporting roll 21. The bottom part of FIG. 1 shows the mounting 46', 47', 48, 49 of a split roll 21.1', 21.2'. This is intended to make it clear that the supporting roll framework designed according to the invention is suitable for the installation of single-piece continuous supporting rolls and for split supporting rolls.

In order for it also to be possible to operate the segment in a wet process, a spray water line 50, 50'51, 51' is provided (FIG. 4). For this purpose, the middle pipe 2, 5 has in each case two connection stubs 52, 52', 53, 53', which are arranged on the lateral surface of the pipe 2, 5. To improve the guidance of the cooling medium in the pipes 1–6 and to reduce the volume, all the pipes 1–6 are provided with a coaxially arranged displacement pipe 54–59, this displacement pipe 54–59 having a smaller external diameter than the internal diameter of the corresponding pipe 1–6.

The invention is not limited by the embodiments described above which are presented as examples only but can be modified in various ways within the scope of protection defined by the appended patent claims.

What is claimed is:

1. A supporting roll framework for continuous metal casting installations, which is divided into segments, comprising: roll carriers for each segment, a plurality of rolls being assembled on each roll carrier, respective pairs of the roll carriers being designed as a flexurally rigid frame element in a welded construction for parallel sides of a metal strand, the rolls being mounted on both sides in bearings having housings which are connected to the roll carrier, both frame elements having a protruding extension at each end, one side element being respectively arranged on each of the frame elements between the protruding extensions of both frame elements, the side element being pressed in and releasably connected to the two frame elements by expansion bolts, the side elements having smooth, planar inner surfaces, both frame elements being provided with carriers which extend in a running direction of the strand and to which the corresponding bearing housing is releasably attached, a cooling medium supply and discharge being integrated in the frame element, and the bearing housing being connected to the cooling medium supply or discharge via the carrier, the frame element having at least two pipes which lie parallel to and at a distance from one another transversely with respect to the running direction of the strand, a web plate being welded between the pipes, and a holding plate is attached to a respectively outer lateral surface of outer of the pipes so as to be directed toward the strand, the carrier which carries the rolls being welded in between the holding plates, the pipes being configured to function as the cooling medium supply and discharge and having a connection stub on an outer lateral surface.

2. A supporting roll framework as defined in claim 1, wherein the protruding extension has a section shaped as a peg so as to be fittable into the pipe and, adjoining the peg-shaped section, a flat section which is laid onto narrow sides, facing the frame parts, of the side elements.

3. A supporting roll framework as defined in claim 1, wherein the frame element has three pipes, which are arranged symmetrically and at a distance from one another, as a carrying element, a middle one of the pipes having a connection stub for cooling medium supply.

4. A supporting roll framework as defined in claim 1, and further comprising a displacement pipe arranged coaxially in each of the pipes so as to form a passage for the cooling medium, each of the displacement pipes having a smaller external diameter than an internal diameter of the pipe in which it is arranged.

* * * * *